US006433691B1

(12) United States Patent
Hilliard et al.

(10) Patent No.: US 6,433,691 B1
(45) Date of Patent: Aug. 13, 2002

(54) PERSONAL COLLISION WARNING AND PROTECTION SYSTEM

(75) Inventors: Donald Patrick Hilliard; Glenda Esnardo Hilliard; Michael Patrick Hilliard; Christina Ann Hilliard, all of Oxnard, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/793,783

(22) Filed: Feb. 27, 2001

(51) Int. Cl.[7] ..... G08B 23/00

(52) U.S. Cl. ..... 340/573.1; 280/728.1; 280/728.2

(58) Field of Search ..... 340/573.1, 573.6, 340/435, 436, 903; 342/61, 72; 280/734, 735, 736, 728.1, 728.2

(56) References Cited

U.S. PATENT DOCUMENTS 4,059,852 A * 11/1977 Crane ..... 2/456
4,089,065 A * 5/1978 McGee ..... 2/456
4,977,623 A * 12/1990 DeMarco ..... 2/456
5,500,952 A * 3/1996 Keyes ..... 2/465
5,535,446 A * 7/1996 Pusic ..... 2/456
5,746,442 A * 5/1998 Hoyaukin ..... 280/730.1
5,896,590 A * 4/1999 Fleisch ..... 2/455
5,937,443 A * 8/1999 Kageyama et al. ..... 2/69
6,032,299 A * 3/2000 Welsh ..... 2/456
6,125,478 A * 10/2000 Alaloof ..... 2/456
6,270,386 B1 * 8/2001 Visocekas ..... 441/80

* cited by examiner

*Primary Examiner*—John Tweel
(74) *Attorney, Agent, or Firm*—David Kalmbaugh

(57) ABSTRACT

A sensor transmits a pulse in the direction of travel of a user and receives reflections from any obstacle in the path. The sensor provides two signals which indicate the relative range and the relative velocity between the user and the obstacle. A decision logic and control circuit processes the signals and determines whether the user and the obstacle are close enough and there is sufficient closing velocity to present a hazard to the user. When the circuit determines there is a hazard, the circuit activates a warning device. An activation signal is also generated when the circuit determines that the user cannot avoid the obstacle. This signal is supplied to an automatic protection system which includes an air bag located on the front portion of a jacket worn by the user. The air bag is inflated by the activation signal to protect the user when colliding with the obstacle.

17 Claims, 2 Drawing Sheets

PERSONAL COLLISION WARNING AND PROTECTION SYSTEM

BACKGROUND OF THE INVENTION

1. Field of the Invention

The present invention relates generally to the field of user protective systems for skiers and the like. More particularly, the present invention relates to a collision warning and protection system for use by a skier or the like to substantially reduce or prevent serious injury in the event the skier collides with a tree or any other object.

2. Description of the Prior Art

Skiing is a recreational activity enjoyed by millions and is generally safe when the skier follows safety rules and uses common sense while skiing. A large percentage of skiing accidents will result in only minor injuries to the skier such as sprained, fractured or broken limbs, bruises and mild concussions or the like.

However, when a skier is skiing in a wilderness setting and is not familiar with the terrain, there is a possibility that the skier could collide with an object which may result in serious injury or death to the skier. For example, if a skier is skiing in a wooded area at dusk there is the possibility that the skier could collide with a tree since the skier is generally traveling at a high rate of speed and would have little time to change direction and thereby avoid the tree. The impact of the skier colliding with the tree will most likely result in serious internal injury or even death.

Accordingly there is a need for a device or system to provide the skier with advanced notice of an object in his path which could be harmful to his or her person. In addition, there is a need for a device or system which will protect the skier in the event that the skier is not able to avoid the object.

There is also a need to provide an individual such as speed skater, a motor cyclist, bicyclist and the like with a warning and protection system which will prevent serious injury or even death to an individual when the individual traveling at a high speed collides with a hazard in his or her path of travel.

SUMMARY OF THE INVENTION

The present invention overcomes some of the disadvantages of the past including those mentioned above in that it comprises a relatively simple yet highly efficient personal collision warning and protection system for use by an individual traveling at a high rate of speed, such as a skier, to prevent injury or even death in the event that the individual collides with a hazard such as a tree.

The protection system of the present invention includes an active sensor device which transmits a pulse in the direction of travel of the user and then receives reflections from any hazards in the path of travel of the user. The active sensor device provides a pair of output signals which indicate the relative range and the relative velocity between the user and the hazard or obstacle in the path of the user. A decision logic and control circuit processes the signals from the sensor device and determines whether the user and the obstacle are close enough and there is sufficient closing velocity to present a collision hazard to the user. When the decision logic and control circuit determines there is a collision hazard the circuit sends a warning signal to a warning device to alert the user of the obstacle in his path. An activation signal is generated when the decision logic and control circuit determines that the user cannot avoid the obstacle and thereby prevent serious harm or death to the user. The activation signal is supplied to an automatic protection system which includes an inflatable air bag located on the front portion of a jacket worn by the user. The air bag is inflated by the automatic protection system in response to the activation signal to protect the user when colliding with the obstacle.

DETAILED DESCRIPTION OF THE PREFERRED EMBODIMENT

Figure 1:
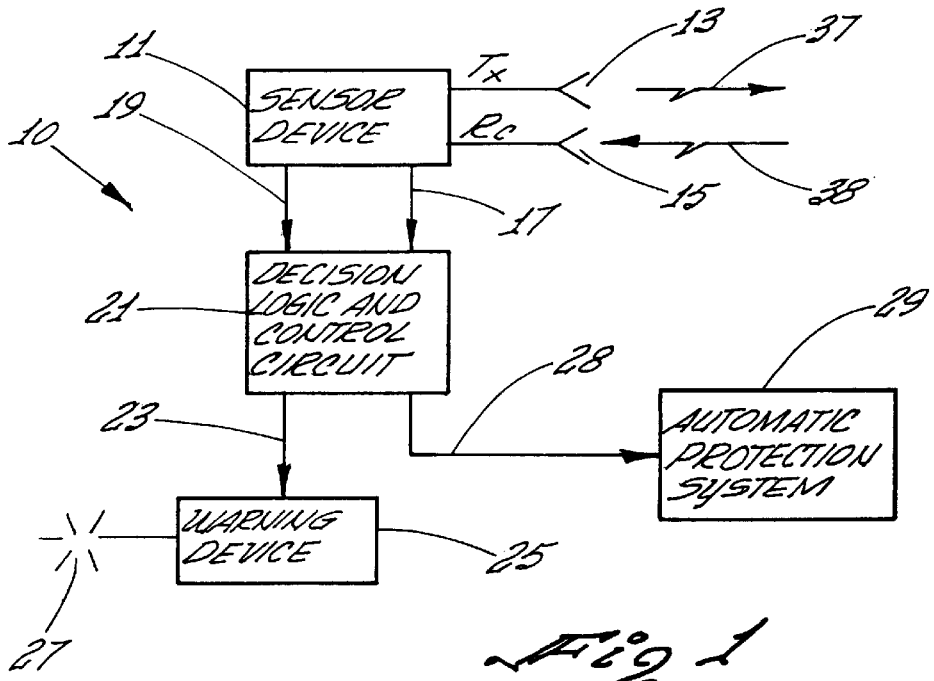
FIG. 1 illustrates an electrical circuit block diagram for the personal collision warning and protection system which constitutes the present invention.
Figure 2:
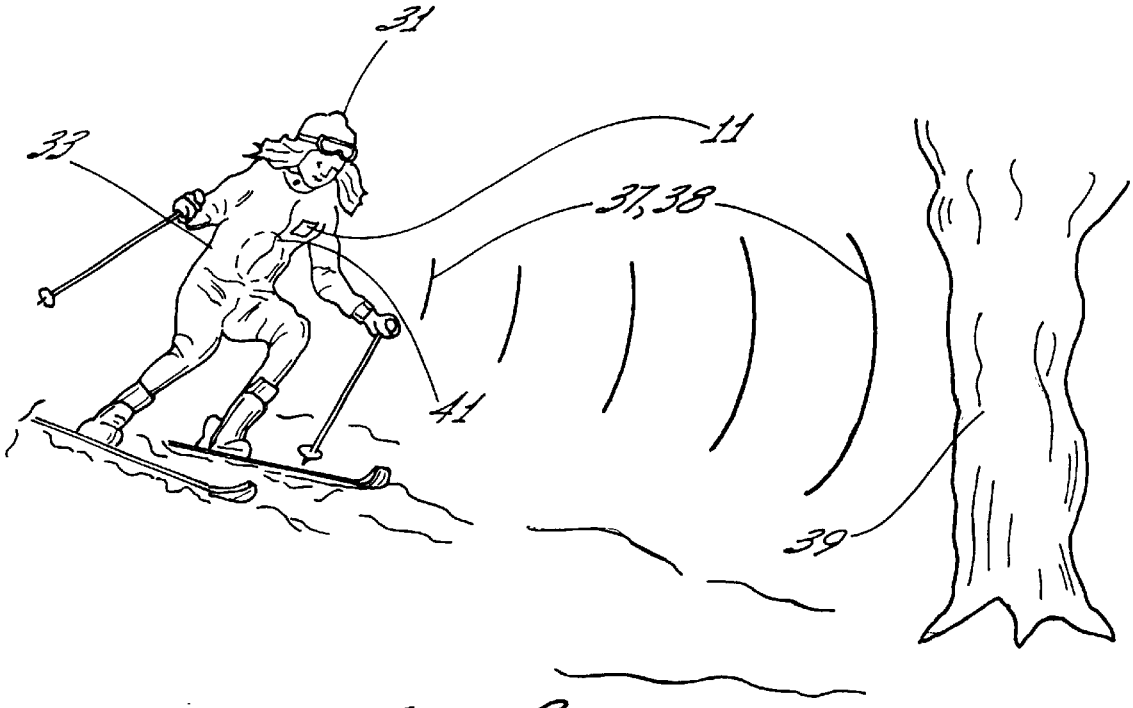
FIG. 2 illustrates a skier using the personal collision warning and protection system of FIG. 1 prior to deployment of the system.
Figure 3:
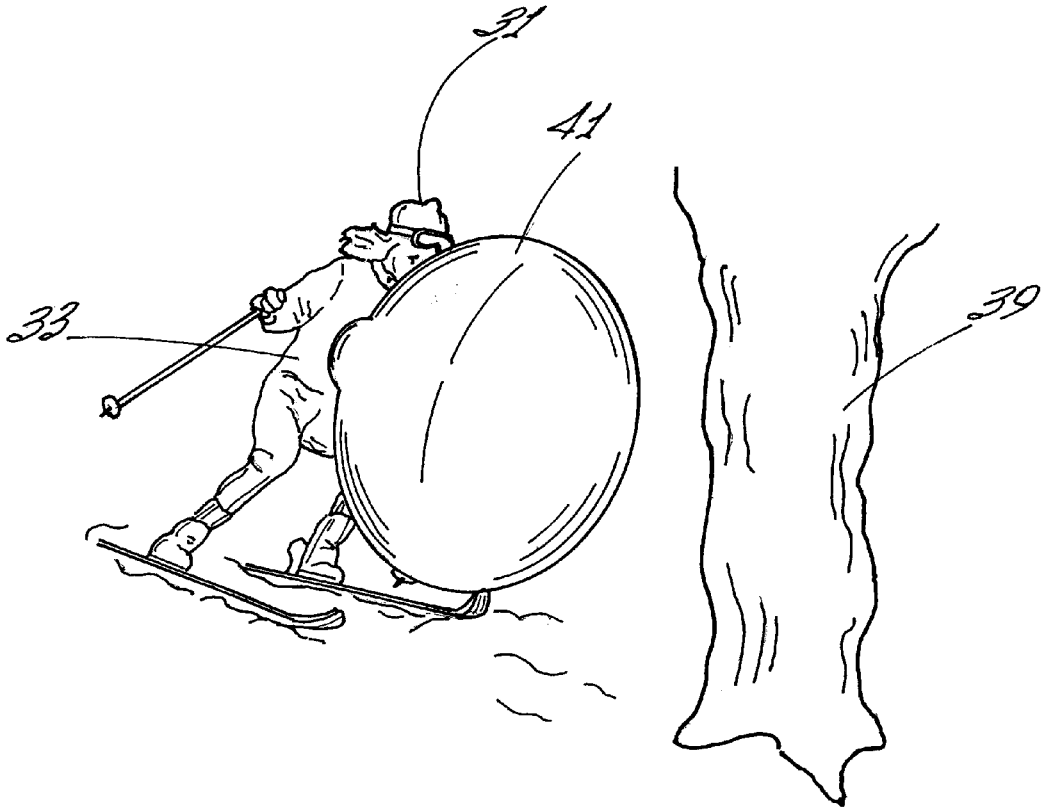
FIG. 3 illustrates a skier using the personal collision warning and protection system of FIG. 1 when an air bag included in the system is deployed to prevent the skier from being injured.

Referring to FIGS. 1, 2 and 3, there is shown an electrical block diagram of the personal collision warning and protection system 10 comprising an active sensor device 11 which transmits a pulsed signal 37 via a transmit antenna 13 in the direction of travel of skier 31. When the pulsed signal 37 hits tree 39, the signal 37 is reflected from tree 39. The reflected signal 38 is received by a receiving antenna 15. Sensor device 11 processes and then provides a pair of electrical signals via connecting wires 17 and 19. A first electrical signal transmitted via wire 17 provides an indication of the relative range/distance of the tree 39 from skier 31. A second electrical signal transmitted via wire 19 provides an indication of the relative or Doppler velocity of the skier 31. The relative range/distance and Doppler velocity information are provided to and processed by a decision logic and control circuit 21. Decision logic and control circuit 21 then makes a determination as to when the combination of an inadequate separation distance between skier 31 and tree 39 and the closing velocity of skier 31 upon tree 39 will result in a collision hazard to the skier 31. Whenever a collision hazard exists, decision logic and control circuit 21 supplies an electrical activation signal via wire 23 to a warning device 25. Warning device 25, which is activated by the activation signal, outputs a warning signal 27 to alert the skier 31 of the collision hazard which as shown in FIGS. 2 and 3 is a tree.

Warning signal 27 may be any of a variety of signals such as an acoustic warning signal, a vibration type warning signal and a visual warning signal. Warning signal 27 allows the skier adequate time to maneuver around 39 and thereby avoid serious injury. Warning device 25 may, for example, be an alarm.

At this time it should be noted that active sensor device 11 may a radar sensing device, an infrared sensing device or laser radar type sensing device.

At this time it should also be noted that Time Domain of Huntsville, Ala. manufactures an ultra-wide-band pulse radio system, identified as the "PulsON" radar chip, which transmits pulses in the manner of sensor device 11 and may be used as sensor device 11.

When the relative range/distance and the closing rate of skier 31 are not adequate to allow skier 31 to maneuver around tree 39, and thereby avoid tree 39 decision logic and control circuit 21 sends an electrical activation signal via wire/signal line 28 to automatic protection system 29. Protection System 29, in response to this electrical activation signal, inflates air bag 41 inflating air bag 41 in the manner in FIG. 3. When fully inflated, air bag 41 provides a cushion for skier 31 absorbing the impact for skier 31 when skier 31 and air bag 41 collide with tree 39.

When, for example, a skier is traveling at a speed of approximately 30–40 miles per hour and is within a 100 yards of a tree or other harmful object warning device 25 may be activated to allow the skier adequate time to change his course and avoid the tree or other harmful object. An adequate time period to allow the skier to change his course may be as little as five seconds or as much as a minute depending upon the skier velocity and the distance the skier is from the obstacle. When, however, the skier is within about twenty five yards of the tree, air bag 41 may inflate to prevent serious injury to the skier upon impacting the tree or other harmful object.

At this time it should be noted that decision logic and control circuit 21 may be a microcomputer or microprocessor which includes software capable of processing the relative range/distance and Doppler velocity information provided to decision logic and control circuit 21 by sensor device 11. Alternatively, decision logic and control circuit 21 may be a programmable array logic (PAL) device which is programmed to process the distance and Doppler velocity information received from sensor device 11. Altera Corporation of San Jose, Calif. manufactures eight families of programmable logic devices which when programmed could function as decision logic and control circuit 21.

Figure 4:
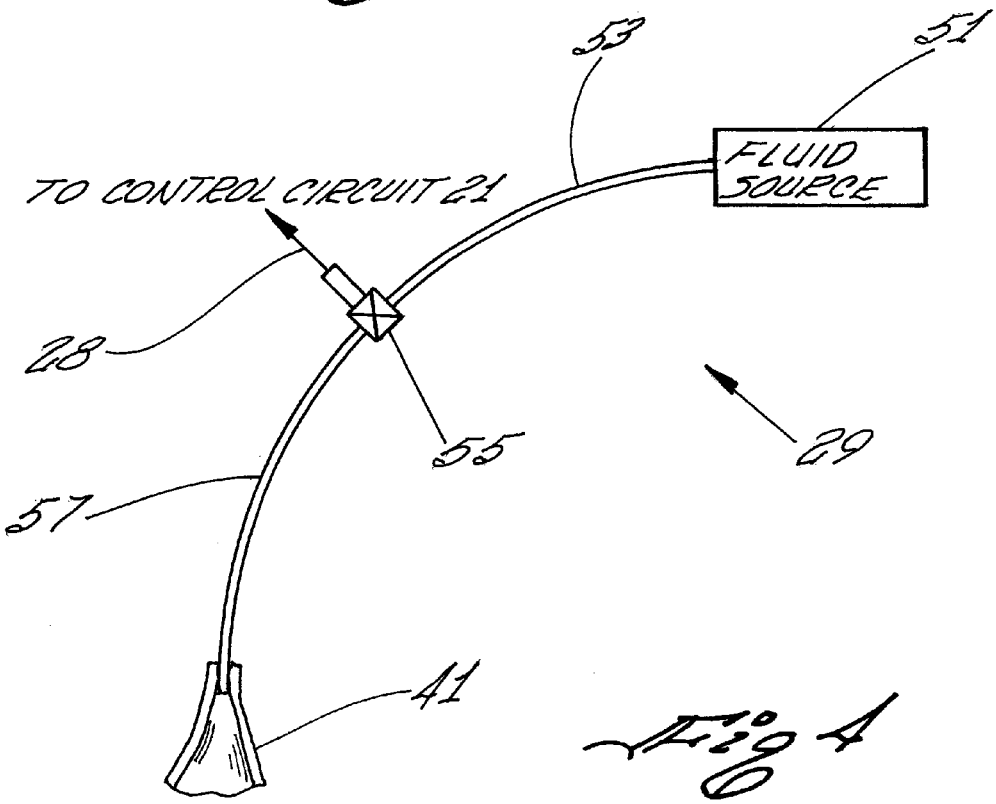
FIG. 4 illustrates a pneumatic diagram of the system for inflating the air bag used in the personal collision warning and protection system which constitutes the present invention.

Referring to FIG. 4, there is shown a detailed fluid flow diagram of the protection system 29. Protection system 29 includes a fluid source 51 of compressed air which supplies the compressed air to air bag 41. Protection system 29 includes a fluid flow passageway 53 which connects the outlet port of source 51 to the inlet port of a normally closed solenoid valve 55 which is electrically activated. Protection system 29 includes a fluid flow passageway 57 which connects the outlet port of solenoid valve 55 to the inlet port of air bag 41. Activation of the solenoid valve 55 by an electrical signal transmitted via signal line 28 from decision logic and control circuit 21 opens the normally closed solenoid valve 55 allowing compressed air to pass from fluid source 51 through valve 55 to the inlet port of air bag 41 inflating air bag 41 in the manner illustrated in FIG. 3. Inflating air bag 41 cushions the impact of skier 31 when skier 31 collides with tree 39 preventing serious internal injury or death to skier 31.

Referring to FIGS. 2 and 3 system 10 may be made an integral component of a ski jacket 33 worn by skier 31. The sensor device 11 is mounted on the front of jacket 33 to allow the pulsed signal 37 to be transmitted in the direction of travel of skier 31 as shown in FIG. 2. Air bag 41 is also mounted on the front of ski jacket 33 so that air bag 41 will inflate in the manner illustrated in FIG. 3 to prevent serious injury to skier 31 when skier 31 impacts tree 39.

The present invention may also be used for preventing injuries to motor cyclist, skate boarders, bicyclist and other individuals traveling at relatively high rates of speed who may have an object in their path which is capable of causing serious injury.

From the foregoing, it may readily be seen that the present invention comprises a new, unique and exceedingly useful personal collision warning and protection system for preventing serious injury to a skier, bicyclist, motor cyclist which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A personal collision warning and protection system comprising:

sensing means for transmitting a pulsed signal in a direction of travel of a person using said collision warning and protection system, said sensing means being mounted on a front portion of a jacket worn by said person;

said sensing means receiving reflections of said pulsed signal, the reflections of said pulsed signal representing an obstacle in the direction of travel of said person;

said sensing means processing the reflections of said pulsed signal to provide a first electrical signal indicating a relative distance of said person from said obstacle and a second electrical signal indicating a Doppler velocity for said person;

processing means connected to said sensing means to receive said first and said second electrical signals, said processing means processing said first and second electrical signals to generate first and second activation signals;

warning means connected to said processing means to receive said first activation signal, said warning means being activated by said first activation signal to warn said person of said obstacle;

protection means connected to said processing means to receive said second activation signal;

said protection means including an air bag positioned on the front portion of said jacket, said protection means being activated by said second activation signal, said protection means when activated inflating said air bag to protect and prevent injury to said person when said person collides with said obstacle.

2. The personal collision warning and protection system of claim 1 wherein said sensing means comprises an ultra-wide-band pulse radio system.

3. The personal collision warning and protection system of claim 1 wherein said processing means comprises a microprocessor.

4. The personal collision warning and protection system of claim 1 wherein said processing means comprises a programmable array logic device.

5. The personal collision warning and protection system of claim 1 wherein said warning means comprises an alarm.

6. The personal collision warning and protection system of claim 1 wherein said automatic protection system includes:

a fluid source of compressed air for supplying compressed air to said air bag, said fluid source having an outlet port; and a normally closed solenoid valve having an inlet port connected to the outlet port of said fluid source and an outlet port connected to said air bag, said normally closed solenoid valve having an electrical input connected to said processing means to receive said second activation signal which opens said normally closed solenoid valve allowing said compressed air to pass through said normally closed solenoid valve to said air bag inflating said air bag.

7. A personal collision warning and protection system comprising:

a sensor device for transmitting a pulsed signal in a direction of travel of a person using said collision warning and protection system, said sensor device being mounted on a front portion of a jacket worn by said person;

said sensor device receiving reflections of said pulsed signal, the reflections of said pulsed signal representing an obstacle in the direction of travel of said person;

said sensor device processing the reflections of said pulsed signal to provide a first electrical signal indicating a relative distance of said person from said obstacle and a second electrical signal indicating a Doppler velocity for said person;

a decision logic and control circuit connected to said sensor device to receive said first and said second electrical signals, said decision logic and control circuit processing said first and second electrical signals to generate first and second activation signals;

a warning device connected to said decision logic and control circuit to receive said first activation signal, said first activation signal activating said warning device to warn said person of said obstacle;

an automatic protection system connected to said decision logic and control circuit to receive said second activation signal;

said automatic protection system including an air bag positioned on the front portion of said jacket, said second activation signal activating said automatic protection system which inflates said air bag to protect and prevent injury to said person when said person collides with said obstacle.

8. The personal collision warning and protection system of claim 7 wherein said sensor device comprises an ultra-wide-band pulse radio system.

9. The personal collision warning and protection system of claim 7 wherein said decision logic and control circuit comprises a microprocessor.

10. The personal collision warning and protection system of claim 7 wherein said decision logic and control circuit comprises a programmable array logic device.

11. The personal collision warning and protection system of claim 7 wherein said warning device comprises an alarm.

12. The personal collision warning and protection system of claim 7 wherein said automatic protection system includes:

a fluid source of compressed air for supplying compressed air to said air bag, said fluid source having an outlet port; and a normally closed solenoid valve having an inlet port connected to the outlet port of said fluid source and an outlet port connected to said air bag, said normally closed solenoid valve having an electrical input connected to said decision logic and control circuit to receive said second activation signal which opens said normally closed solenoid valve allowing said compressed air to pass through said normally closed solenoid valve to said air bag inflating said air bag.

13. A personal collision warning and protection system comprising:

a sensor device for transmitting a pulsed signal in a direction of travel of a person using said collision warning and protection system, said sensor device being mounted on a front portion of a jacket worn by said person;

said sensor device receiving reflections of said pulsed signal, the reflections of said pulsed signal representing an obstacle in the direction of travel of said person;

said sensor device processing the reflections of said pulsed signal to provide a first electrical signal indicating a relative distance of said person from said obstacle and a second electrical signal indicating a Doppler velocity for said person;

a decision logic and control circuit connected to said sensor device to receive said first and said second a electrical signals, said decision logic and control circuit processing said first and second electrical signals to generate first and second activation signals;

a warning device connected to said decision logic and control circuit to receive said first activation signal, said first activation signal activating said warning device to warn said person of said obstacle and to allow said person a time period sufficient to avoid said obstacle by steering around said obstacle;

an automatic protection system connected to said decision logic and control circuit to receive said second activation signal; and said automatic protection system including:

an air bag positioned on the front portion of said jacket;

a fluid source of compressed air for supplying compressed air to said air bag, said fluid source having an outlet port; and a normally closed solenoid valve having an inlet port connected to the outlet port of said fluid source and an outlet port connected to said air bag, said normally closed solenoid valve having an electrical input connected to said decision logic and control circuit to receive said second activation signal which opens said normally closed solenoid valve a allowing said compressed air to pass through said is normally closed solenoid valve to said air bag inflating said air bag to protect and prevent injury to said person when said person collides with said obstacle.

14. The personal collision warning and protection system of claim 13 wherein said sensor device comprises an ultra-wide-band pulse radio system.

15. The personal collision warning and protection system of claim 13 wherein said decision logic and control circuit comprises a microprocessor.

16. The personal collision warning and protection system of claim 13 wherein said decision logic and control circuit comprises a programmable array logic device.

17. The personal collision warning and protection system of claim 13 wherein said warning device comprises an alarm.

* * * * *